US005795505A

United States Patent [19]

Burns

[11] Patent Number: 5,795,505

[45] Date of Patent: Aug. 18, 1998

[54] AIR HUMIDIFIER WITH REDUCED MINERAL BUILDUP

[75] Inventor: Rodney B. Burns, Calgary, Canada

[73] Assignee: Harry Penno, Alberta, Canada

[21] Appl. No.: 908,224

[22] Filed: Aug. 7, 1997

Related U.S. Application Data

[63] Continuation of Ser. No. 642,094, May 2, 1996, abandoned.

[51] Int. Cl.[6] ..... B01F 3/04

[52] U.S. Cl. ..... 261/92

[58] Field of Search ..... 261/92

[56] References Cited

U.S. PATENT DOCUMENTS

| | | | |
|---|---|---|---|
| 2,054,039 | 9/1936 | Persons | 261/92 |
| 2,060,636 | 11/1936 | Persons | 261/92 |
| 2,253,418 | 8/1941 | Crandall et al. | 261/92 |
| 3,481,588 | 12/1969 | Lobb | 261/92 |
| 3,705,479 | 12/1972 | McPherson | 261/92 |
| 3,724,824 | 4/1973 | Mitich | 261/92 |
| 3,774,588 | 11/1973 | Yeagle | 261/92 |
| 3,799,517 | 3/1974 | Tamm | 261/128 |
| 3,823,922 | 7/1974 | McElreath | 261/92 |
| 4,036,597 | 7/1977 | Filss | 261/92 |
| 4,056,582 | 11/1977 | Chow | 261/92 |
| 4,185,687 | 1/1980 | Stockman | 261/92 |
| 4,399,031 | 8/1983 | Imano et al. | 261/92 |
| 5,171,486 | 12/1992 | Penno | 261/92 |

*Primary Examiner*—Tim R. Miles
*Attorney, Agent, or Firm*—Quarles & Brady

[57] ABSTRACT

A furnace humidifier uses radial air flow through a spaced stack of annular disks rotated through a water bath to provide humidification with reduced encrustation of the water carrying surfaces from minerals in the evaporating water. The disk array is followed by a damper volume providing more uniform air flow through the disk spaces better utilizing the water on their surfaces.

7 Claims, 3 Drawing Sheets

AIR HUMIDIFIER WITH REDUCED MINERAL BUILDUP

This is a continuation, of application Ser. No. 08/642,094 filed May 2, 1996, now abandoned.

FIELD OF THE INVENTION

The present invention relates to humidifiers, such as may be used on a forced-air furnace or the like, and in particular, to a humidifier having high humidity output and improved resistance to the build-up of mineral deposits.

BACKGROUND OF THE INVENTION

Humidifiers associated with forced air heating systems can offset the decrease in relative humidity that occurs when cold air is heated in the winter months. Humidified air is healthier and a constant level of humidity throughout the season can reduce damage to wooden furniture and flooring caused by cycles of swelling and shrinkage. Humidified air can also reduce the build-up of static electrical charges.

One common type of humidifier uses a open cell foam pad that is saturated in water by rotation through a water trough. The saturated foam is then moved into a stream of heated air in the furnace to humidify that air. Typically the humidifier is located in a bypass between the hot and cold air ducts so that a portion of the heated air passes through the humidifier and back to the cold air return. The humidifier is normally activated only when the furnace fan is blowing to save power and to reduce excess build-up of humidity in the furnace.

A common problem with evaporative humidifiers is that the water carrying surface becomes encrusted with minerals (naturally found in hard water) which can significantly decrease the humidifier's air flow and effectiveness. This problem may be exacerbated by water carriers that entrain water. This excess water, evaporating when the humidifier stops with natural cycling of the furnace, may build up thick layers of minerals that resist dislodgment or dissolving when the humidifier is started again.

SUMMARY OF THE INVENTION

The present invention provides a humidifier that uses a set of closely spaced disks which pick up a thin film of water when rotated through a water bath. The non-entrapping surface of the disks avoids the mineral build-up associated with foam water carriers and the like. A high humidity output from such non-entraining surfaces is possible because the air is conducted through a center channel in the disks to pass outwardly from this channel through the space between the disks. The more uniform air flow provided by this path maximizes the moisture received by the air stream.

More specifically, the present invention provides an air humidifier including a plurality of annular disks spaced along a substantially horizontal common axis. Each disk has a radial inner and outer edge and the inner edges together define an inner volume. A lower portion of a housing enclosing the disks is positioned beneath the disks to hold water at a water level and a motor assembly connected to the disks rotates the disks about their common axis so that a portion of the disks passes beneath the water level as the disks rotate. An air conduit communicates with the inner volume so that air may be conducted through the conduit into the inner volume and then pass outward between the disks to be humidified.

It is thus one object of the invention to obtain the advantages of a non-entrapping water carrying surface, insofar as that reduces mineral build-up, without significantly decreasing the ability of the humidifier to add moisture to the air. It is believed that the radial flow of air from the center volume to the outside of the disks increases the amount of disk area exposed to flowing air, over designs where air is passed across rotating disks from the outside.

The humidifier may also include a tubular chamber attached to the disks, the chamber having an opened end abutting the inner volume of the disks opposite the air conduit and an opposite closed end removed from the disks. The tubular chamber is sized to smooth the flow of air from the air conduit through the spaces between the disks and to promote uniform air flow between the disks.

Thus it is another object of the invention to provide uniform air flow between each disk so that each disk may contribute as much water as possible to the humidification process.

The surface of the disks may be roughened to improve their wetting. The speed of the motor is adjusted to cause the disks to remain wet for substantially one revolution.

Thus it is another object of the invention to increase the amount of water carried by the disks and exposed to the evaporating air, without unduly exposing the disks to excess mineral build-up.

The disks may be constructed of a molded polymer and may be connected to the motor assembly by a separable coupling.

Thus, it is another object of the invention to provide a humidifier whose water carrying element may be simply constructed and removed for washing.

The foregoing and other objects and advantages of the invention will appear from the following description. In this description reference is made to the accompanying drawings, which form a part hereof, and in which there is shown by way of illustration a preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENT

Figure 1:
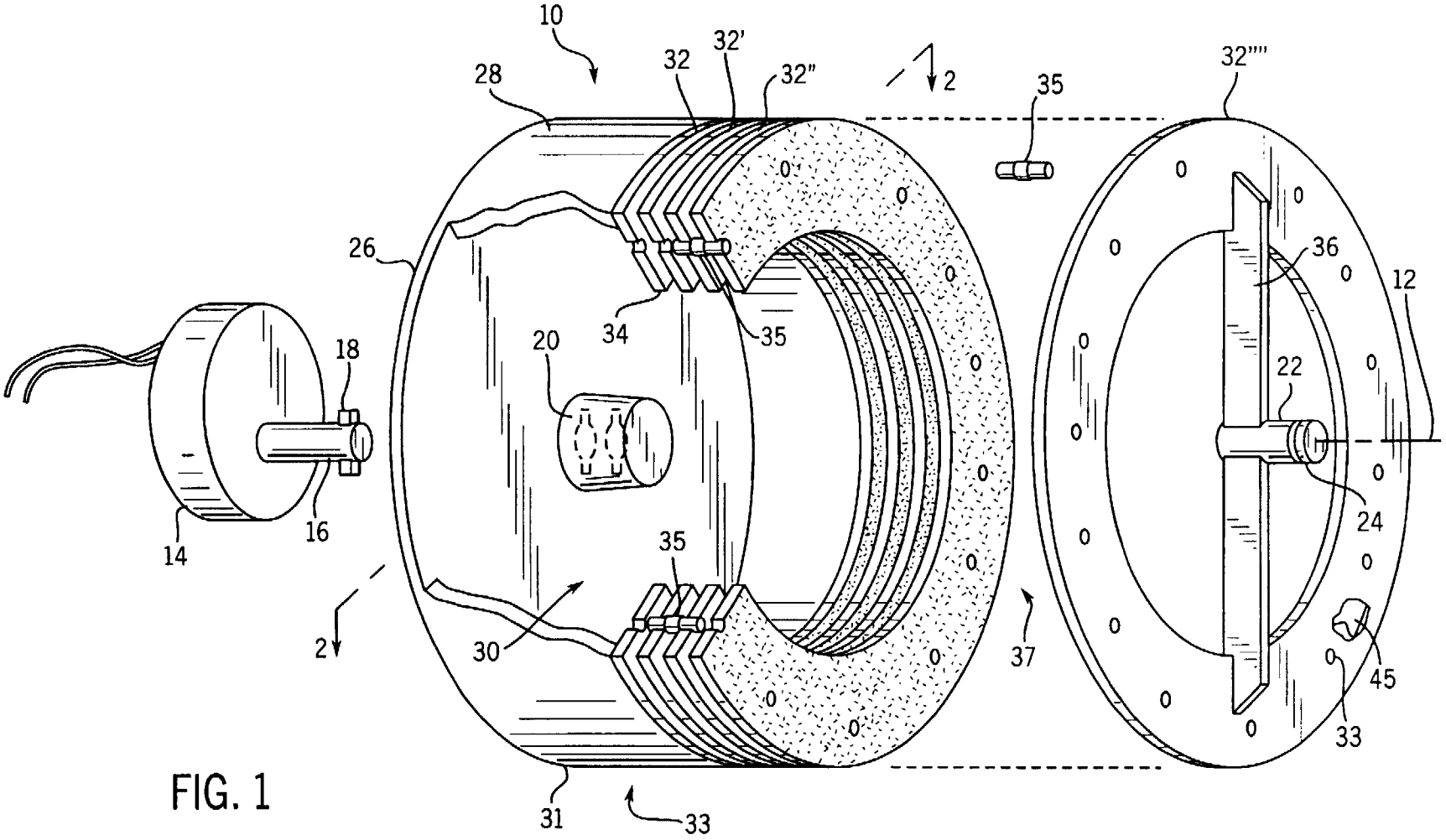
FIG. 1 is a perspective and partial cut away view of the water carrier assembly of the humidifier of the present invention showing a series of disks spaced apart around a common horizontal axis and capped at the end by an air cushion chamber, the inner edges of the disks defining an air receiving chamber.

Referring to FIG. 1, a humidifier constructed according to the present invention employs a generally cylindrical water carrier 10 which may rotate about a horizontal axis 12 as driven by a gear motor 14 at approximately 4 rpm.

The gear motor 14 has a shaft 16 that is keyed with key 18 to fit within a corresponding socket 20 at one end of the cylindrical water carrier 10. The key 18 prevents relative rotation between the shaft 16 and the water carrier 10 when the shaft 16 is within socket 20 but permits removal of the water carrier 10 and socket 20 from the shaft 16 by pulling water carrier 10 away from motor 14 along axis 12.

An axle 22 extends along axis 12 outward from the other end of the water carrier 10 to support the water carrier 10 (with shaft 16) when the water carrier 10 is rotated by the motor 14. Axle 22 includes a circumferential groove 24 which may fit within a corresponding groove in a support strut 52 (shown in FIG. 2) The strut 52 is a thin bar having in its upper edge a semi-circular notch 54 into which fits the groove 24 of the axle 22 so as to prevent motion of the water carrier 10 along axis 12 when the groove 24 and notch 54 of the strut 52 are so engaged.

Nevertheless, axle 22 may be lifted from the notch 54 in the support strut 52 so that the water carrier 10 may be moved in the axial direction 12 to release shaft 16 of the motor from the socket 20 so that the entire water carrier 10 may be easily removed for cleaning.

The end of the water carrier 10 having the socket 20 provides a circular base 26 in which the socket 20 is centered and axially extending walls 28 providing an air cushion 31 enclosing a cylindrical air cushion volume 30. The circular edge of the walls 28 of the air cushion 31 removed from the base 26 are attached to the outer edge of a first annular disk 32 centered about axis 12 and having an inner edge 34 displaced radially inward from the outer edge of the disk 32.

The annular disk 32 attaches by means of a number of standoffs 35 parallel to axis 12 to another identical disk 32' also centered about axis 12 but displaced away from the air cushion 31 and from first disk 32 by approximately one sixteenth inch. This disk 32' is in turn attached to a next disk 32" by additional standoffs 35 and so forth until 40–60 such disks 32 have been attached together in spaced relationship centered about axis 12 continuing the cylindrical form of the outer wall 28 of the air cushion 31. The very last disk 32"" is spanned by a diametric brace 36 the center of which holds the axle 22 centered on axis 12.

Each annular disk 32 is approximately 9 inches in diameter and approximately one sixteenth inch thick and has a generally rectangular cross section taken along a line of radius from the axis 12. The disks 32 may be constructed of a thermoplastic so as to be manufactured by conventional injection molding or the like.

The inner edges 34 of the disks 32 together define an inner cylindrical volume 37 free from obstruction except for the minor obstruction of the brace 36 and axle 22.

The surfaces of the disks 32 may be roughened to improve their water carrying capacity but are generally without perforations except for the holes 33 which receive the ends of the standoffs 35 and thus do not trap water in pockets but rather carry a thin film of water on their surface during their operation.

Figure 2:
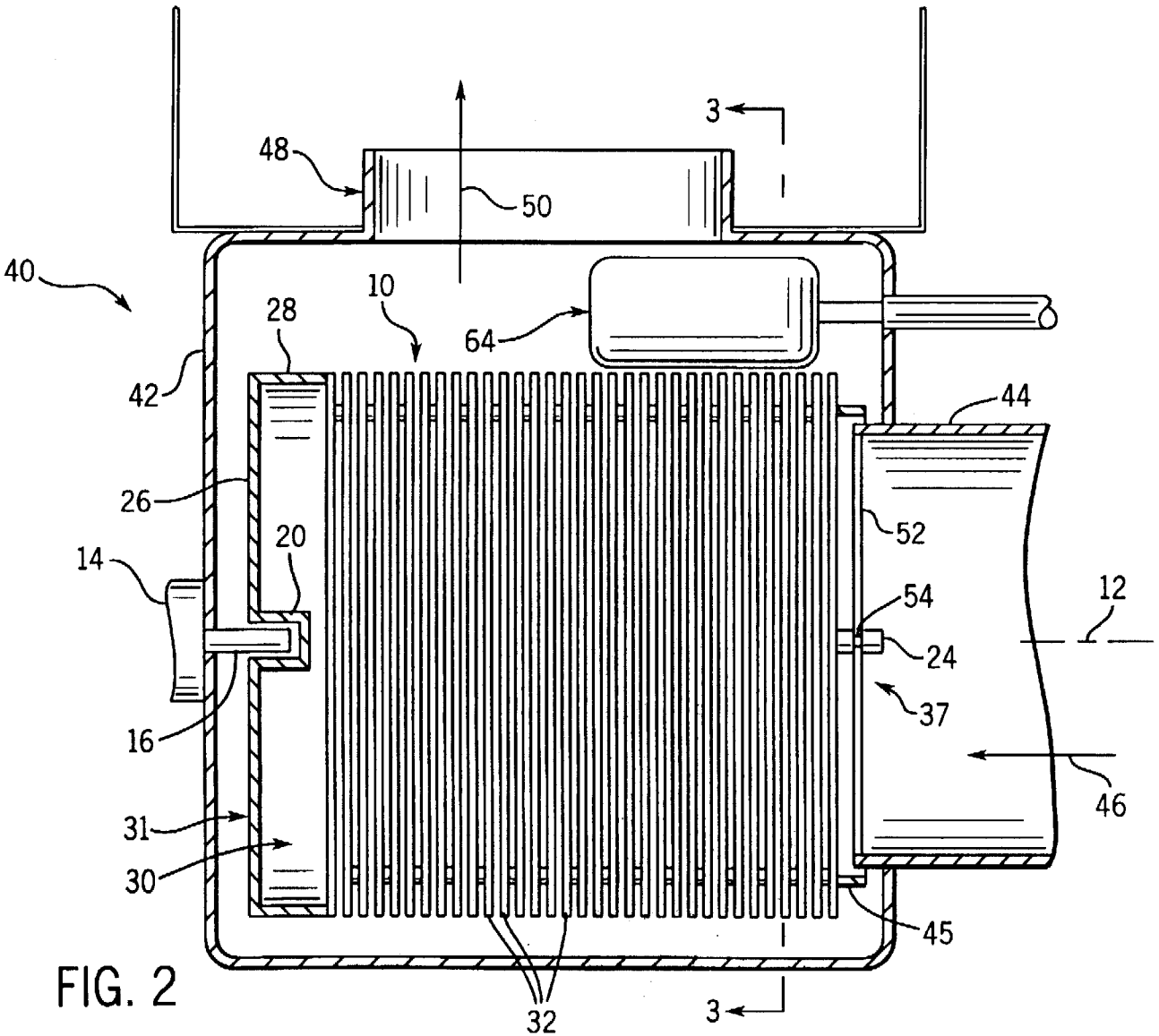
FIG. 2 is a partial cut away of the water carrier of FIG. 1 (along line 2—2 of FIG. 1) as positioned within a housing which serves to admit air into the inner volume of the water carrier of FIG. 1 so that it may exit between the spaced apart disks.

Referring now to FIG. 2, the water carrier 10 is enclosed within housing 42 formed of two interfitting shells 56 and 58. The housing 42 provides two air ports: an air inlet 44 receiving air 46 along axis 12 into the inner volume 37 past the axle 22, and an air outlet 48 allowing humidified air 50 to pass out of the housing 42 after it has passed into the inner volume 37 and through the spaces separating the disks 32. The air inlet is spanned by the support strut 52 previously described.

The air inlet 44 may be sized to be substantially equal in diamter to the diameter of the inner edges 34 and to be closely spaced (approximately 1/81") to the disk 32 nearest the air inlet 44 so as to prevent air flow other than into volume 30. An optional collar 45 may extend outward from the disk 32 closest to the air inlet 44 to loosely surround the air inlet 44 providing a serpentine and therefore high resistance path to air not flowing into volume 30.

Figure 3:
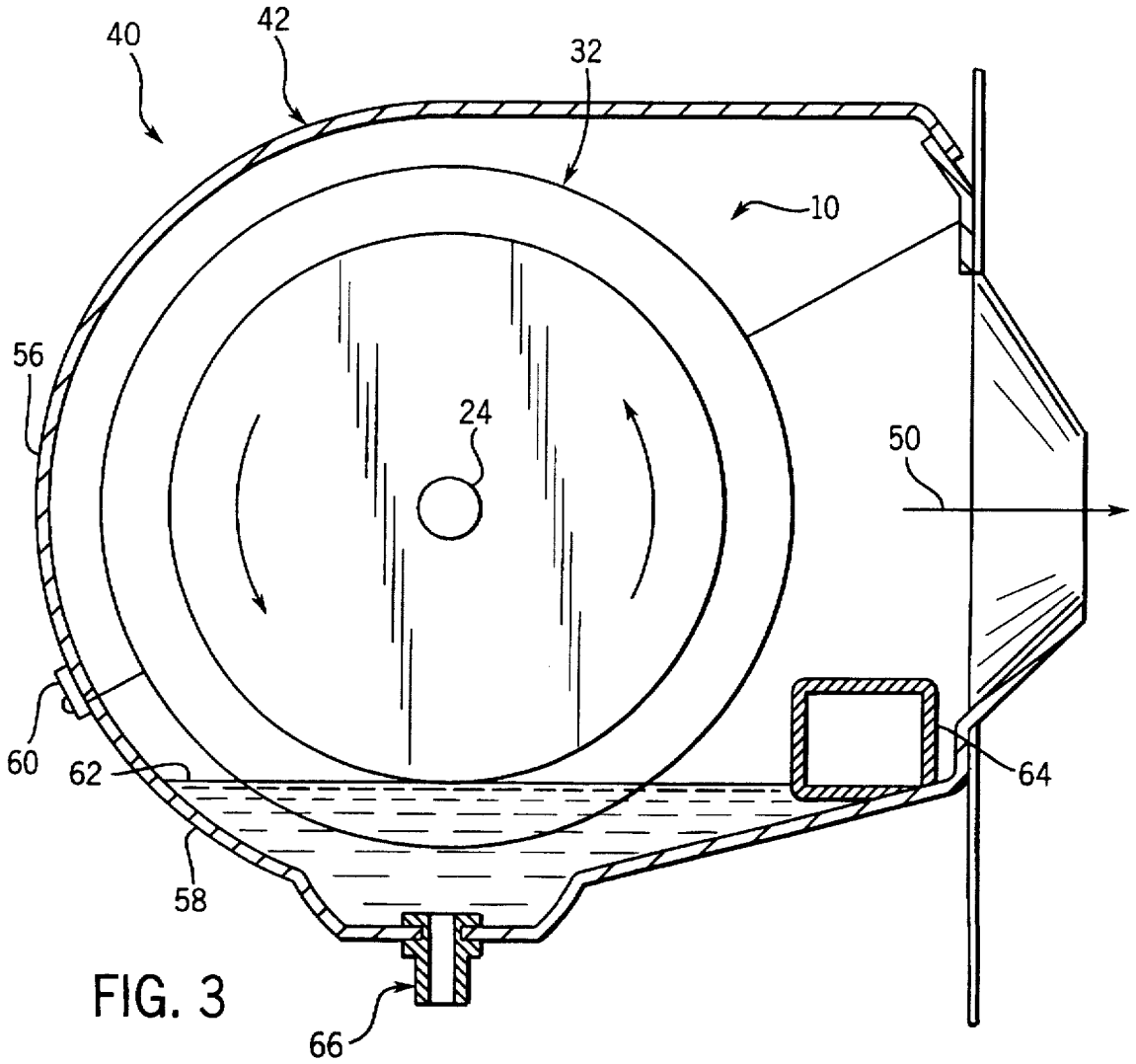
FIG. 3 is an elevational cross section (along line 3—3 of FIG. 2), showing the lower portion of the housing which holds water serves to immerse a portion of the disks as they revolve about their common horizontal axis yet which reduces the need for a large volume of stagnant water.

Referring also to FIG. 3, housing shells 56 and 58 may be attached together by a flange 60 so that the first shell 56 may be raised providing access to the water carrier 10. Removal of the water carrier 10 may thus be accomplished by raising shell 56 and lifting the axle 22 away from notch 54 and then drawing the water carrier 10 along the axis 12 so that socket 20 disengages with shaft 16. The water carrier assembly may in this way be readily fit into a residential dishwasher for washing or may be easily replaced.

The lower shell 58 of housing 42 provides a lower portion 62 holding water at a level that just rises to the inner edge of the disks 32 so that when the disks 32 are rotated about axis 12, the entire surface of the rings is immersed within water 62.

A float assembly 64, as will be understood to those of ordinary skill in the art, provides metered water to the lower shell 58 to maintain the water level at the height necessary to submerge the lower portion of the disks 32 up to their inner radius.

It will be understood that the water holding volume formed by lower shell 58 may conform substantially to the outer radius of the disks 32 thus limiting the amount of standing water in the lower shell 58 to the minimum amount. A drain port 66 may be coupled with a stop-cock (not shown) to provide for periodic draining of the lower shell 58 to remove sediment and the like.

The air flow from within the volume 30 formed by the disks 32, between the disks 32, and out of the housing 42 is believed to provide superior evaporation of the water on the surface of the disks 32 thus providing sufficient humidification of that air without the need for water entrapping cellular foam and the like such as may readily clog with sediment and minerals. Although the applicants do not wish to be bound by a particular theory, it is believed that the water retention of the foam exacerbates mineral build-up during the periods when the furnace fan is not running. At these times the large amounts of retained water evaporates slowing without replenishment from immersion in the water trough. In the present invention, the relatively low amount of water retained on the disks 32 (ideally just enough to completely evaporate in one cycle of the disks 32) when evaporated, leaves only a thin film of minerals that may be dissolved at a subsequent immersion when the furnace starts again.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made.

I claim:

1. An air humidifier comprising:

a plurality of annular disks spaced along a substantially horizontal common axis, the disks having radially inner and outer edges, the inner edges defining an inner volume;

a portion of a lower housing positioned beneath the disks to hold water at a water level;

a motor assembly connected to the disks to rotate the disks about their common axis so as to change the portion of the disks that is beneath the water level as the disks rotate;

an air conduit communicating with the inner volume;

whereby air conducted through the conduit into the inner volume may pass outward between the disks to be humidified;

further including a tubular chamber having an open end abutting the inner volume and substantially preventing axial air flow from an opening of the inner volume of the disks opposite the air conduit, the tubular chamber further having an opposite closed end removed from the disks, the chamber sized to even the flow of air from the air conduit through the spaces between the disks.

2. The humidifier of claim 1 wherein surfaces of the disks are roughened to carry a film of water as they rotate.

3. The humidifier of claim 1 including a water height control controlling the water level to be substantially equal in depth to the distance between the radial inner and outer edges of the disks.

4. The humidifier of claim 1 including a drain at the bottom of the lower housing permitting removal of the water of the tray and any sediment in that water.

5. The humidifier of claim 1 wherein the disks are interconnected by standoffs extending outward from surfaces of the disks.

6. The humidifier of claim 1 wherein the motor assembly connects to the disks by means of a separable coupling permitting the disks to be removed for washing.

7. The humidifier of claim 1 wherein the air inlet communicates with the inner volume through a low leakage interface resisting air flow from the air inlet bypassing the inner volume the interface including a collar overlapping with the air inlet.

* * * * *

UNITED STATES PATENT AND TRADEMARK OFFICE

CERTIFICATE OF CORRECTION

PATENT NO. : 5,795,505

DATED : August 18, 1998

INVENTOR(S) : Rodney B. Burns

It is certified that error appears in the above-identified patent and that said Letters Patent is hereby corrected as shown below:

Column 3, line 67, 1/81" should read --1/8"

Signed and Sealed this

Sixth Day of April, 1999

*Attest:*

*Attesting Officer*

Q. TODD DICKINSON

*Acting Commissioner of Patents and Trademarks*